US006903694B2

(12) United States Patent
Kim

(10) Patent No.: US 6,903,694 B2
(45) Date of Patent: Jun. 7, 2005

(54) ANTENNA UNIT USING HELICAL HINGE SPRING

(75) Inventor: Young-Jin Kim, Suwon-shi (KR)

(73) Assignee: Samsung Electronics Co., Ltd. (KR)

( * ) Notice: Subject to any disclaimer, the term of this patent is extended or adjusted under 35 U.S.C. 154(b) by 257 days.

(21) Appl. No.: 10/337,727

(22) Filed: Jan. 7, 2003

(65) Prior Publication Data

US 2003/0137468 A1 Jul. 24, 2003

(30) Foreign Application Priority Data

Jan. 18, 2002 (KR) ..... 2002-2934

(51) Int. Cl.[7] ..... H01Q 1/24
(52) U.S. Cl. ..... 343/702; 343/895
(58) Field of Search ..... 343/702, 895; 455/90

(56) References Cited

U.S. PATENT DOCUMENTS 6,115,886 A 9/2000 Fujita ..... 16/336
6,259,897 B1 * 7/2001 Kim ..... 455/575.7
6,272,356 B1 8/2001 Dolman et al. ..... 343/702

FOREIGN PATENT DOCUMENTS

DE 100 06 530 A1 8/2001 ..... H01R/12/32
EP 1 263 189 A2 12/2002 ..... H04M/1/02
JP 2001284934 10/2001 ..... H01Q/1/24

OTHER PUBLICATIONS

European Search Report dated Aug. 11, 2003 issued in a counterpart application, namely, Appln. No. 03001202.5.

* cited by examiner

*Primary Examiner*—Hoang V. Nguyen
(74) *Attorney, Agent, or Firm*—Dilworth & Barrese, LLP

(57) ABSTRACT

Disclosed is an antenna unit using a helical hinge spring which is used for a portable terminal including (A) a main housing, (B) a sub housing, and (C) a hinge module rotatably opening and closing the sub housing from and into the main housing and including a hinge shaft having one end attached to the main housing and the other end positioned within the sub housing and serving to interconnect the main housing and the sub housing, a hinge cam being slid by the hinge shaft and moving forward and backward, the helical hinge spring for providing a force for closely adhering the hinge shaft to the hinge cam, and a hinge housing for accommodating the hinge shaft, the hinge cam, and the helical hinge spring, the antenna unit comprising: (a) the helical hinge spring disposed in a direction of a hinge axis and serving as a helical antenna; and (b) a conductive member including a contact portion disposed between the helical hinge spring and the hinge cam and closely adhered to the helical hinge spring, and a center portion extending from a center of the contact portion in the direction of the hinge axis and passing through the hinge cam and the hinge shaft.

18 Claims, 15 Drawing Sheets

[HELICAL ANTENNA (OPEN STATUS) RADIATION PATTERN IN PCS BAND]

[HELICAL ANTENNA (CLOSED STATUS) RADIATION PATTERN IN PCS BAND]

[HELICAL HINGE SPRING ANTENNA (OPEN STATUS) RADIATION PATTERN IN PCS BAND]

[HELICAL HINGE SPRING ANTENNA (CLOSED STATUS) RADIATION PATTERN IN PCS BAND]

[CHIP-TYPE ANTENNA (OPEN STATUS) RADIATION PATTERN IN BLUE TOOTH BAND

[CHIP-TYPE ANTENNA (CLOSED STATUS) RADIATION PATTERN IN BLUE TOOTH BAND

[HELICAL HINGE SPRING ANTENNA (OPEN STATUS) RADIATION PATTERN IN BLUE TOOTH BAND]

[HELICAL HINGE SPRING ANTENNA (CLOSED STATUS) RADIATION PATTERN IN BLUE TOOTH BAND]

ANTENNA UNIT USING HELICAL HINGE SPRING

This application claims priority to an application entitled "ANTENNA UNIT USING HELICAL HINGE SPRING", filed in the Korean Industrial Property Office on Jan, 18, 2002 and assigned Serial No. 2002-2934, the contents of which are hereby incorporated by reference.

BACKGROUND OF THE INVENTION

1. Field of the Invention

The present invention relates to an antenna unit of a portable terminal, and more particularly to an antenna unit using a helical hinge spring installed on the hinge module.

2. Description of the Related Art

Usually, a portable terminal refers to a portable unit for communicating with a counterpart via wireless communication with a base station. These portable terminals are divided into several types, e.g., bar-type terminals, flip-type terminals, folder-type terminals, flip up-type terminals, and folder-type terminals for being also used as a PDA, according to their shape. Further, the portable telephone terminals may be divided into telephone terminals for voice communication, telephone terminals for picture communication, telephone terminals for Internet communication, telephone terminals for Internet gaming, and telephone terminals for chatting, according to their function. Moreover, the portable telephone terminals may be divided into necklace types, wristlet types, and pocket-sized types, according to their wearing locations.

Each of the aforementioned individual portable terminals essentially comprises an antenna unit, a data input/output unit, and a data transmitting/receiving unit to facilitate communication with the counterpart. As the usually used data input unit, a keypad or a touch sensitive panel is employed. The keypad comprises an array of a plurality of keys for inputting data by a pressing action. The touch sensitive panel serves to input data by a touching action. Further, a display such as a LCD (Liquid Crystal Display) module is also commonly used as the data output unit. A microphone unit is used as the data transmitting unit and a speaker unit is used as the data receiving unit.

Portable terminals having multiple functionality and that are suitable for various multi-media environments are being spotlighted and popularized.

In order to transmit/receive radio waves, conventional portable terminals essentially comprises an antenna, a power-feeding portion, and an RF (Radio Frequency) unit. The conventional antennas of the portable terminal are divided into two types, i.e., an internal type and an external type. The internal type antenna is installed within a main housing of the portable terminal. The external type antenna protrudes from the main housing of the portable terminal and is exposed to the outside. As the conventional antenna, a helical antenna or a whip antenna is usually employed. Herein, the helical antenna serves as a main antenna and the whip antenna serves as an auxiliary antenna.

However, in case of using an internal type antenna installed on a designated area of a printed circuit board within the main housing of the portable terminal, the portable terminal requires an internal space for accommodating the internal type antenna, making it difficult to effectively utilize the limited space available within the main body of the portable terminal. That is, the portable terminal using the internal antenna has a drawback of increasing the size of the printed circuit board.

On the other hand, the external type antenna protrudes from the main body of the portable terminal, thereby limiting the external design of the portable terminal. Further, when the portable terminal falls to the ground due to the user's carelessness, the external type antenna is easily broken. Since the external antenna of the portable telephone terminal protrudes from the main body housing, this protruded external antenna of the portable terminal is easily damaged.

SUMMARY OF THE INVENTION

Therefore, the present invention has been made in view of the above problems, and it is an object of the present invention to provide an antenna unit using a hinge spring, thereby maintaining antenna characteristics and not requiring a further space for accommodating the antenna unit.

It is another object of the present invention to provide an antenna unit using a hinge spring, which satisfies a miniaturization trend.

It is another object of the present invention to provide an antenna unit using a hinge spring, which can be used as an auxiliary antenna.

In accordance with one aspect of the present invention, the above and other objects can be accomplished by the provision of an antenna unit using a helical hinge spring which is used in a portable terminal including (A) a main housing, (B) a sub housing, and (C) a hinge module rotatably opening and closing the sub housing from and into the main housing and including a hinge shaft having one end fixedly attached to the main housing and the other end positioned within the sub housing and serving to interconnect the main housing and the sub housing, a hinge cam being slid by the hinge shaft and moving forward and backward, the helical hinge spring for providing a force for closely adhering the hinge shaft to the hinge cam, and a hinge housing for accommodating the hinge shaft, the hinge cam, and the helical hinge spring, the antenna unit comprising: (a) the helical hinge spring disposed in a direction of a hinge axis and serving as a helical antenna; and (b) a conductive member including a contact portion disposed between the helical hinge spring and the hinge cam and closely adhered to the hinge spring, and a center portion extending from a center of the contact portion in the direction of the hinge axis and passing through the hinge cam and the hinge shaft.

In accordance with another aspect of the present invention, there is provided to an antenna unit using a helical hinge spring which is used in a portable terminal including (A) a main housing, (B) a sub housing, and (C) a hinge receptor rotatably opening and closing the sub housing from and into the main housing and including a hinge shaft having one end fixedly attached to the main housing and the other end positioned within the sub housing and serving to interconnect the main housing and the sub housing, a hinge cam being slid by the hinge shaft and moving forward and backward, and the helical hinge spring for providing a force for closely adhering the hinge shaft to the hinge cam, the antenna unit comprising: (a) the helical hinge spring disposed in a direction of a hinge axis and serving as a helical antenna; and (b) a conductive member including a contact portion closely adhered to the helical hinge spring, and a center portion extending from a center of the contact portion in the direction of the hinge axis and passing through the hinge spring, the hinge cam and the hinge shaft.

In accordance with still another aspect of the present invention, there is provided to a hinge apparatus of a portable terminal including a hinge housing, a hinge shaft disposed within the hinge housing, a hinge cam disposed within the hinge housing and being slid by the hinge shaft, a helical hinge spring disposed in a direction of the hinge housing, and serving to closely adhere the hinge shaft to the hinge cam and simultaneously serving as a helical antenna; and a conductive member including a contact portion disposed between the helical hinge spring and the hinge cam and closely adhered to the helical hinge spring, and a center portion extending from a center of the contact portion in the direction of the hinge axis and passing through the hinge cam and the hinge shaft.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
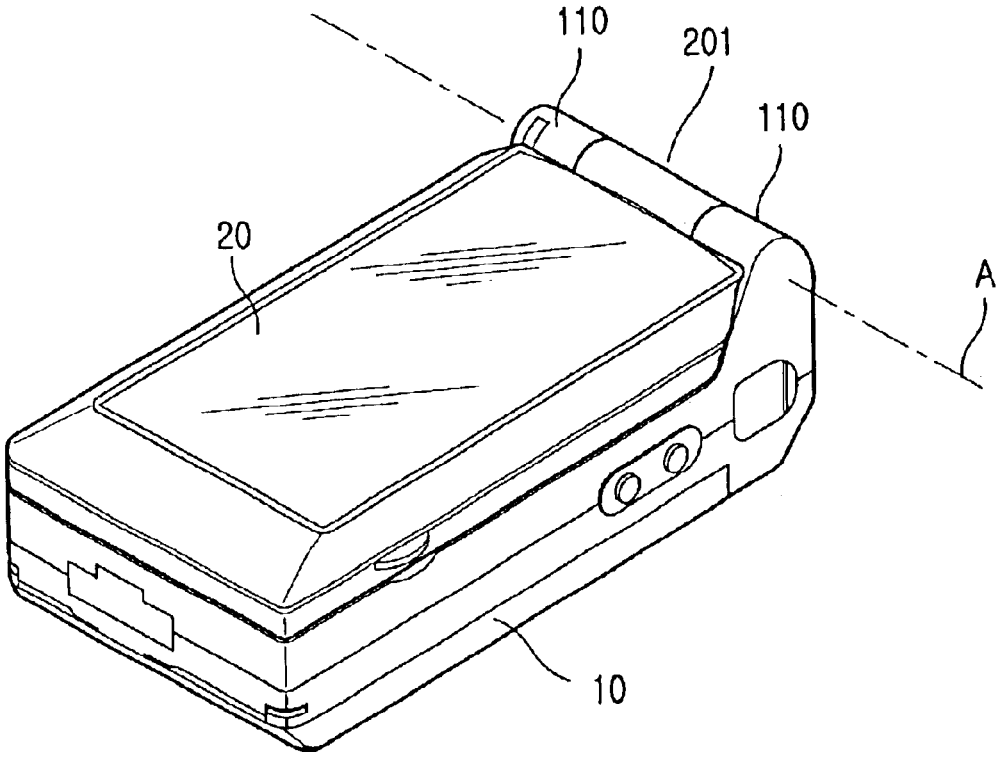
FIG. 1 is a perspective view of a portable terminal in which a sub housing is closed.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations is omitted to avoid making the subject matter of the present invention unclear.

Figure 2:
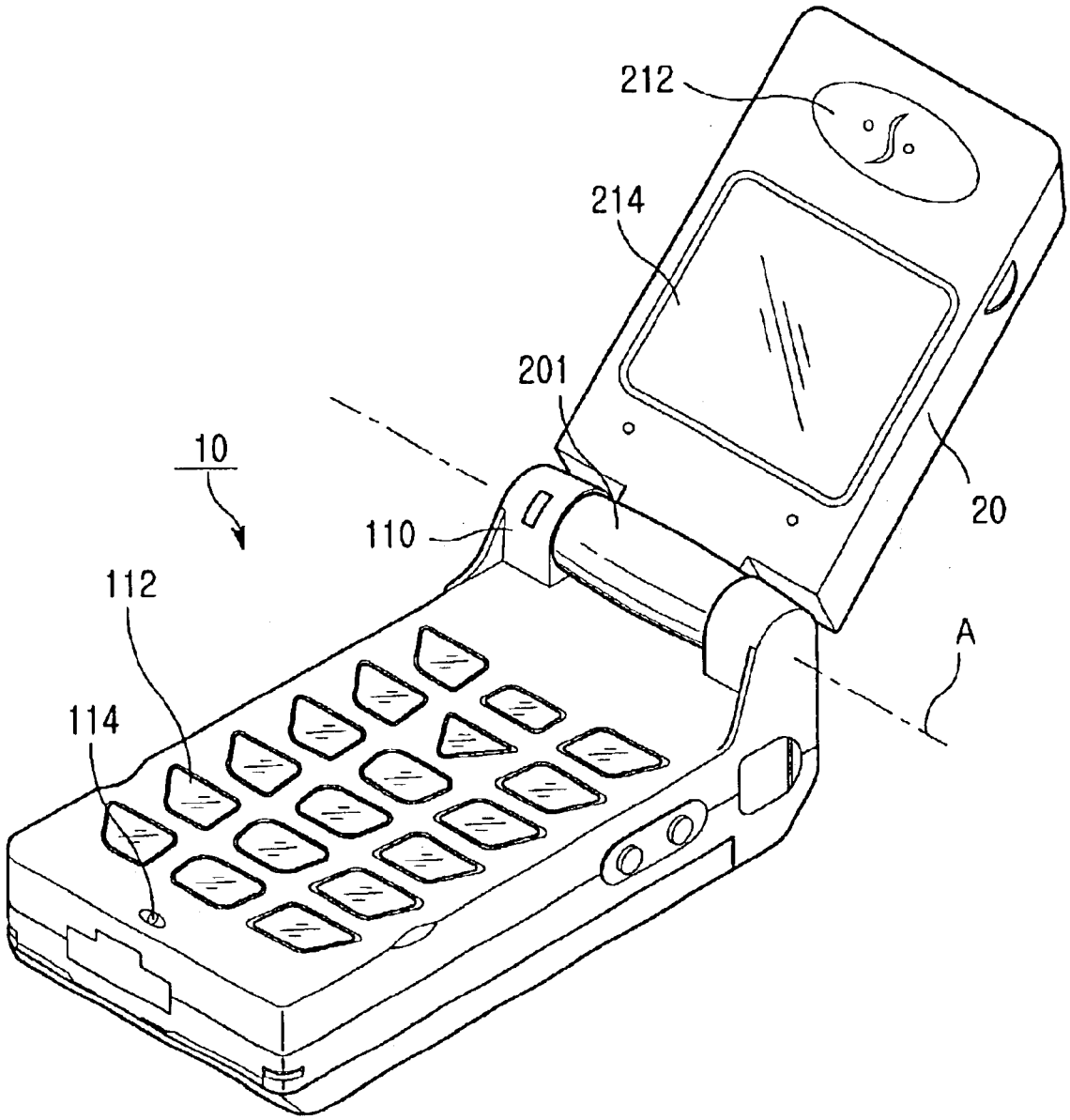
FIG. 2 is a perspective view of the portable terminal in which the sub housing is open.

FIG. 1 is a perspective view of a portable terminal in which a sub housing is closed, and FIG. 2 is a perspective view of the portable terminal in which the sub housing is open. The portable terminal of FIGS. 1 and 2 also comprises an antenna unit (shown in FIG. 3) using a helical hinge spring in accordance with the first preferred embodiment of the present invention. The portable terminal comprises a main housing 10, a sub housing 20, and a hinge unit. The hinge unit rotatably connects the sub housing 20 to the main housing 10, thereby opening and closing the sub housing 20 from and into the main housing 10. That is, the sub housing 20 rotatably moves on a rotation axis A within a designated angle. The main housing 10 comprises a key array consisting of a plurality of keys 112, and a microphone unit 114. The sub housing 20 comprises a speaker unit 212 and a LCD 214.

The main housing 10 includes two side hinge arms 110. One side hinge arm 110 is symmetrically opposite to the other side hinge arm 110. The sub housing 20 includes a center hinge arm 201. The center hinge arm 201 of the sub housing 20 is held between the two side hinge arms 110 of the main housing 10 by the hinge unit.

Figure 3:
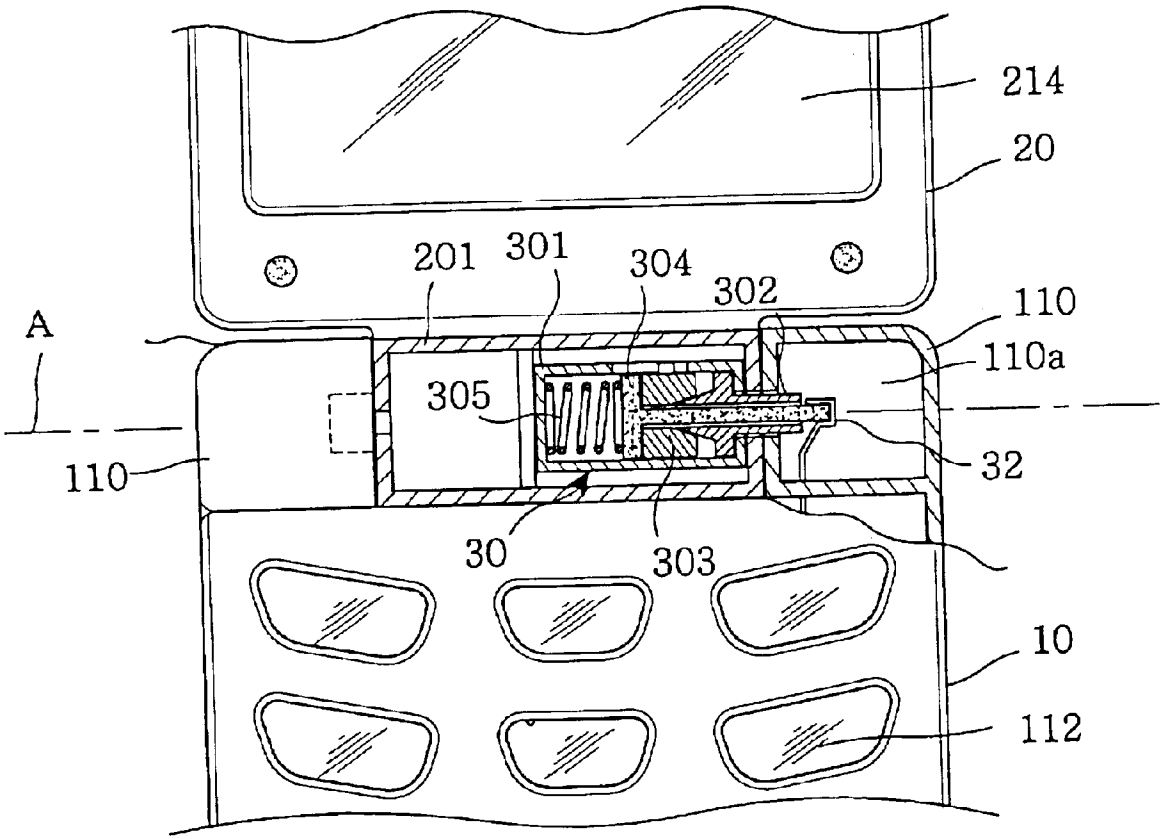
FIG. 3 is a partial cut-away plan view of the portable terminal in which the sub housing is open, showing in cut-away an antenna unit using a helical hinge spring in accordance with the first preferred embodiment of the present invention.

As shown in FIG. 3, a hinge module 30 applied to the portable terminal functions first to rotatably connect the sub housing 20 to the main housing 10 and secondarily to provide a force for closing the sub housing 20 within a first range of designated angles (0°~45°), provide a force for opening the sub housing 20 in a second range of more than the first range of designated angles (45°~140°), and provide a force for stopping the motion of the sub housing 20 at another third designated angle (140°). That is, the hinge module 30 of the portable terminal provides a user with a force for easily opening and closing the sub housing 20 from and into the main housing 10. Therefore, the hinge module 30 essentially comprises a hinge shaft 302, a hinge cam 303, and a helical hinge spring 305. Further, a hinge housing 301 may be used to separately assemble the hinge shaft 302, the hinge cam 303, and the helical hinge spring 305 of the hinge module 30.

The hinge module 30 of the first preferred embodiment of the present invention, particularly the helical hinge spring 305 is used as the antenna unit. FIG. 3 shows the antenna unit using the helical hinge spring 305 of the hinge module 30 in accordance with the first embodiment of the present invention.

As shown in FIG. 3, the antenna unit of the first embodiment of the present invention comprises the hinge module 30, more particularly the helical hinge spring 305 accommodated within the hinge housing 301, a conductive member 304, and a plate spring 32 located within internal space 110*a* of side hinge arm 110. The conductive member 304 is accommodated within the hinge housing 301 so as to electrically connect the helical hinge spring 305 to a power-feeding portion (not shown). The plate spring 32 is closely adhered to the conductive member 304, thereby electrically connecting the conductive member 304 to the power-feeding portion.

Figure 4:
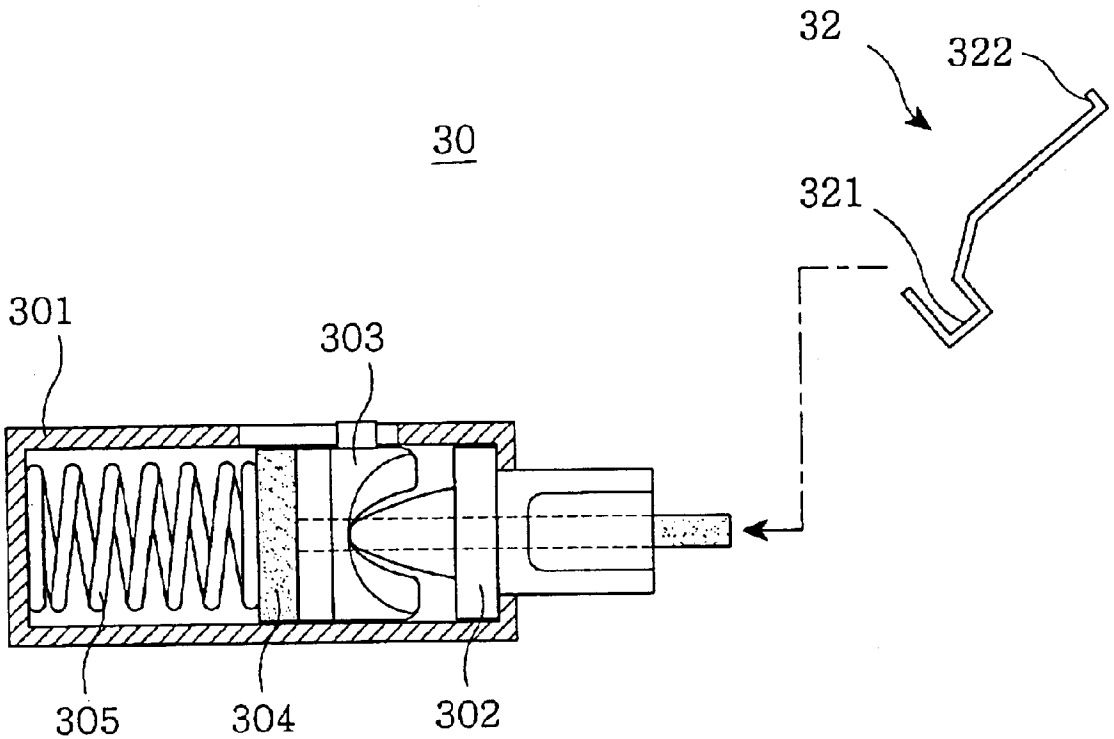
FIG. 4 is a partially exploded plan view of the antenna unit using the helical hinge spring in accordance with the first embodiment of the present invention.
Figure 5:
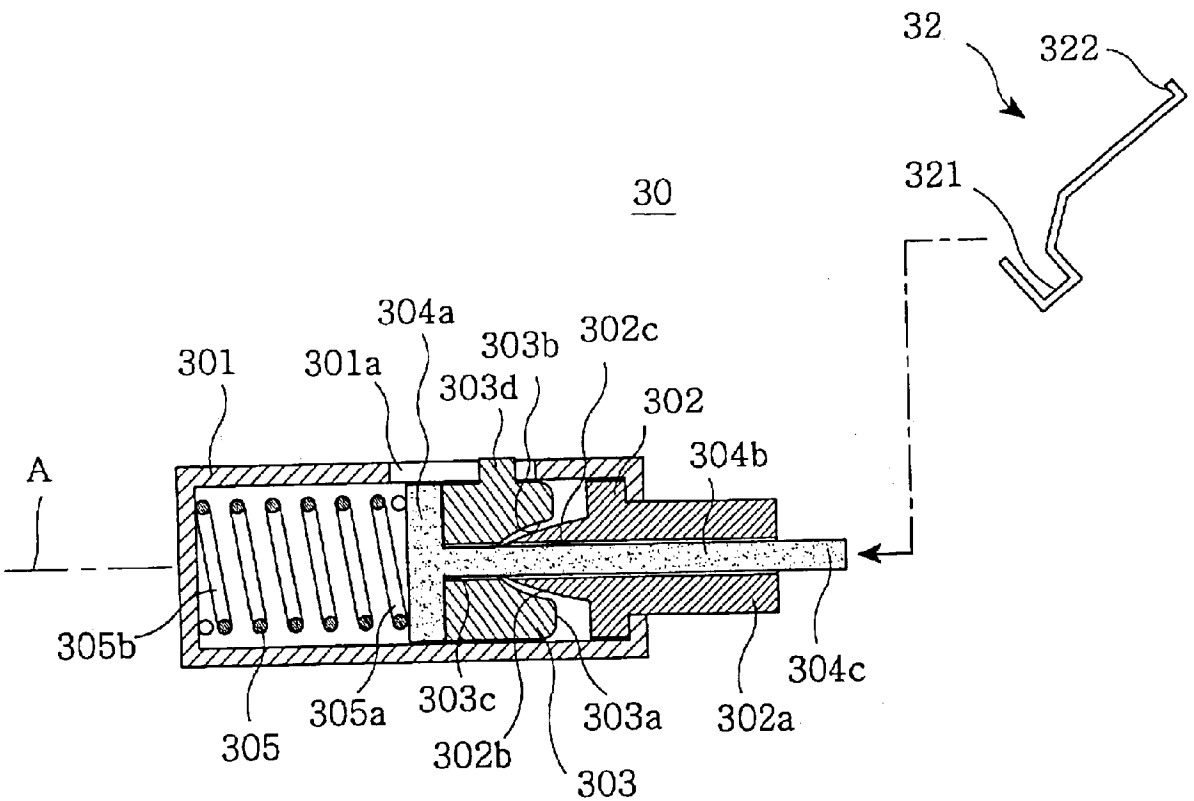
FIG. 5 is a cross-sectional view of the antenna unit of FIG. 4.

FIG. 4 is a partially exploded plan view of the antenna unit using the helical hinge spring in accordance with the first preferred embodiment of the present invention, and FIG. 5 is a cross-sectional view of the antenna unit of FIG. 4. Hereinafter, with reference to FIGS. 4 and 5, the antenna unit of the first preferred embodiment of the present invention is described in detail.

As shown in FIGS. 4 and 5, the antenna unit of the first embodiment of the present invention utilizes the hinge module 30. In order to supply a force for opening and closing the sub housing, the hinge module comprises the hinge housing 301, the hinge shaft 302, the hinge cam 303, and the helical hinge spring 305. The antenna unit of the first embodiment of the present invention is embodied using the helical hinge spring 305 installed on the hinge module and the conductive member 304 separate from the helical hinge spring 305.

The hinge housing 301 is installed on the center hinge arm 201 of the sub housing 20, and accommodates the hinge shaft 302, the hinge cam 303, the conductive member 304, and the helical hinge spring 305. One end 302*a* of the hinge shaft 302 is engaged with the side hinge arm 110 of the main housing 10 and the other end 302*b* of the hinge shaft 302 is a convex portion. Further, a through hole 302*c* is formed in the hinge shaft 302 along the hinge axis. The hinge shaft 302 is fixedly attached to the side hinge arm 110. Therefore, as the sub housing 20 is opened and closed from and into the main housing 10, the hinge cam 303 slides due to its engagement with convex portion 302*b* of hinge shaft 302.

The hinge cam 303 includes convex portion 303*a* and a concave portion 303*b*. A protrusion 303*d* is formed on the outer circumference of the hinge cam 303; the protrusion 303*d* guides the hinge cam 303 forward and backward within the hinge housing 301. The hinge cam 303 is slid by the hinge shaft 302, and thereby moves forward and backward along the length direction of the hinge housing 301. A through hole 303*c* is formed in the hinge cam 303 along the hinge axis.

The conductive member 304 includes a contact portion 304*a* disposed between the hinge cam 303 and the helical hinge spring 305 and being in contact with one end 305*a* of the helical hinge spring 305, and a center portion 304*b* being inserted into the through hole 303*c* of the hinge cam 303 and the through hole 302*c* of the hinge shaft 302. A terminal 304*c* of the center portion 304*b* of the conductive member 304 has a designated length so as to protrude from the surface of the hinge shaft 302. The diameter of the center portion 304*b* of the conductive member 304 is smaller than that of the through holes 302*c* and 303*c*. Therefore, the conductive member 304 is not influenced by the straight-line motion of the hinge shaft 302 or the hinge cam 303.

The helical hinge spring 305 is disposed between the hinge housing 301 and the conductive member 304. One end 305*a* of the helical hinge spring 305 is always in contact with the contact portion 304*a* of the conductive member 304, thereby functioning to closely adhere the hinge shaft 302 to the hinge cam 303.

The plate spring 32 is made of a conductive material with elasticity. The plate spring 32 includes two free terminals, i.e., a first free terminal 321 and a second free terminal 322. The first free terminal 321 of the plate spring 32 is bent to be connected to the terminal 304*c* of the center portion 304*b* of the conductive member 304, and the second free terminal 322 of the plate spring 32 is connected to the power-feeding portion of a main printed circuit board (not shown). Herein, the first free terminal 321 of the plate spring 32 is closely adhered to the terminal 304*c* of the conductive member 304 by an elastic force of the plate spring 32.

When the sub housing is opened and closed from and into the main housing, the hinge shaft 302 is bound by one of the side hinge arms 110, and the hinge cam 303 moves forward and backward by the hinge shaft 302. Then, the helical hinge spring 305 is compressed and then extends. Further, the conductive member 304 is maintained in close adherence with the hinge spring 305. Therefore, the helical hinge spring 305 is always electrically connected to the plate spring 32 by the conductive member 304, and is connected to the power-feeding portion via the plate spring 32.

Figure 6:
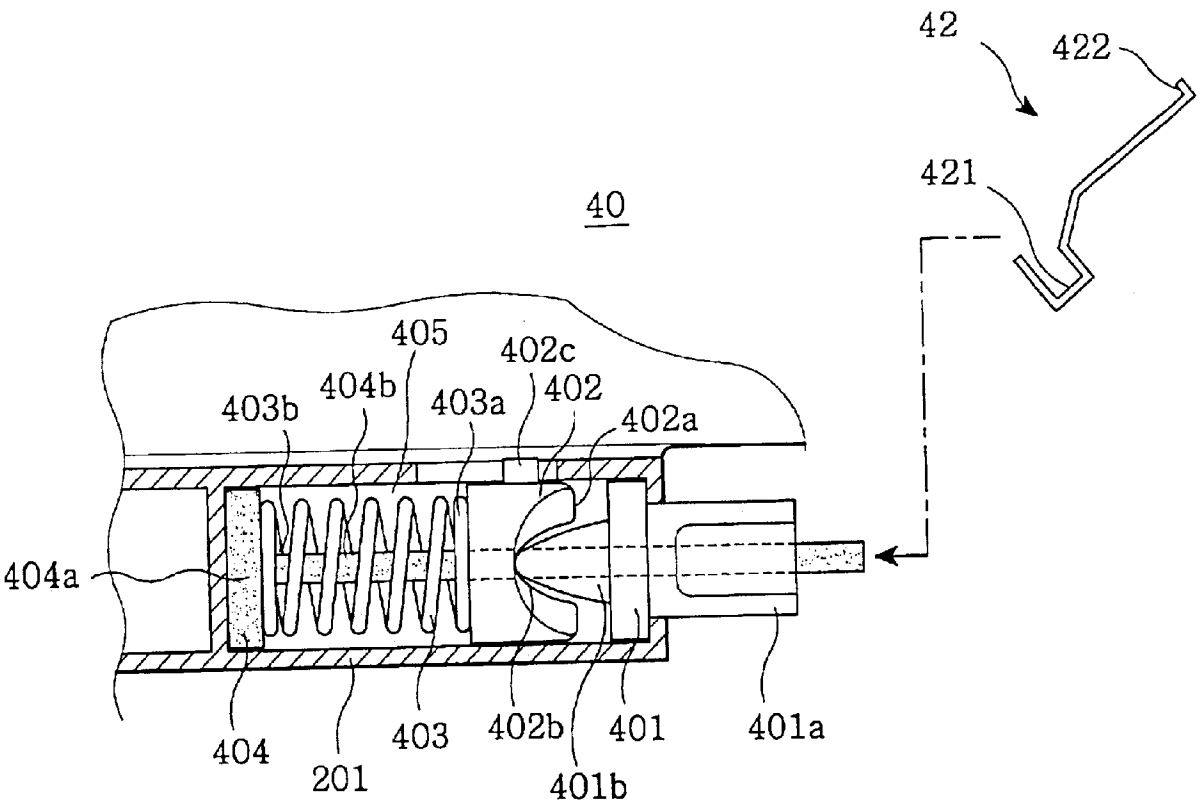
FIG. 6 is a partially exploded plan view of an antenna unit using a helical hinge spring in accordance with a second preferred embodiment of the present invention.
Figure 7:
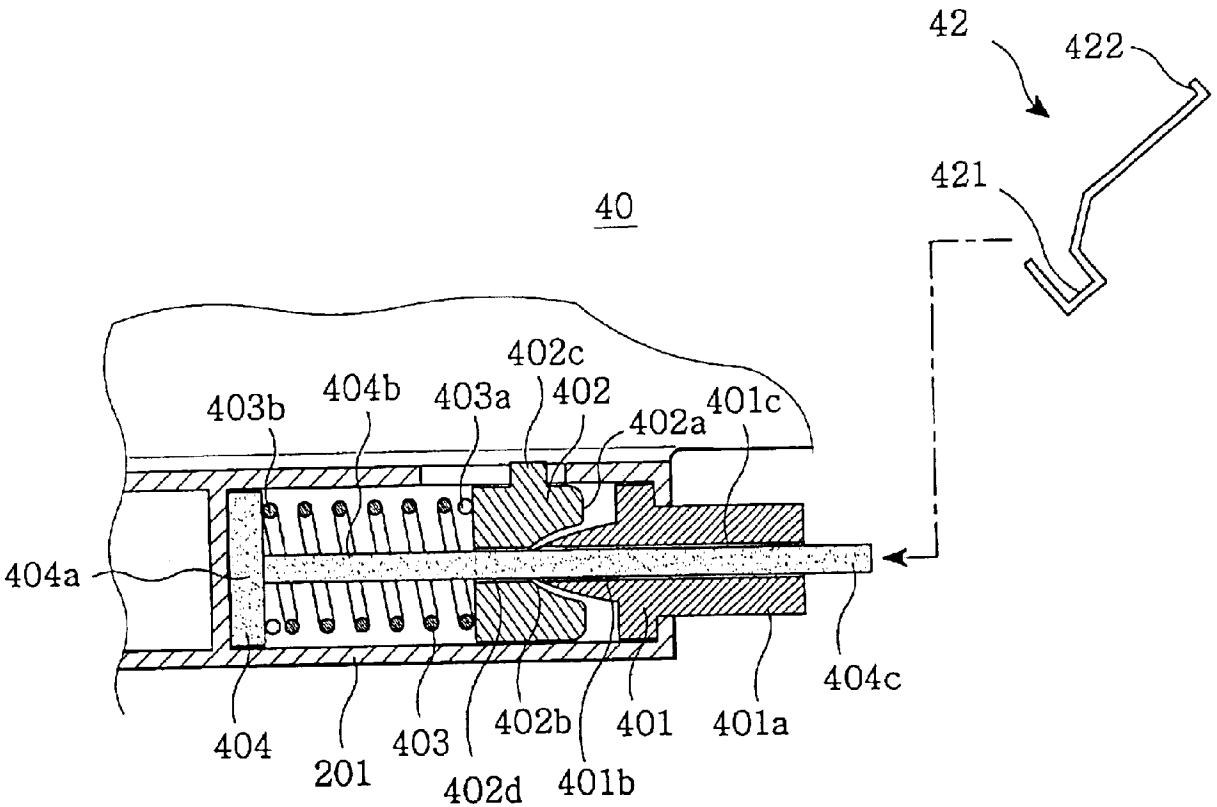
FIG. 7 is a cross-sectional view of the antenna unit of FIG. 6.

FIG. 6 is a partially exploded plan view of an antenna unit using a helical hinge spring in accordance with a second preferred embodiment of the present invention, and FIG. 7 is a cross-sectional view of the antenna unit of FIG. 6. Hereinafter, with reference to FIGS. 6 and 7, the antenna unit using the helical hinge spring 403 of the second preferred embodiment of the present invention is described in detail. As shown in FIGS. 6 and 7, the antenna unit using the helical hinge spring 403 of the second embodiment of the present invention utilizes a hinge module 40. In order to supply a force for opening and closing the sub housing, the hinge module 40 serving as the hinge means of the portable terminal comprises a hinge shaft 401, a hinge cam 402, and the helical hinge spring 403. The antenna unit of the second embodiment of the present invention is embodied using the helical hinge spring 403 installed on the hinge module 40 and a conductive member 404.

The hinge shaft 401, the hinge cam 402, the conductive member 404, and the helical hinge spring 403 are accommodated within a hinge receptor 405 installed within the center hinge arm 201 of the sub housing 20. One end 401*a* of the hinge shaft 401 protrudes from the hinge receptor and the other end 401*b* of the hinge shaft 401 is a convex portion. A through hole 401*c* is formed in the hinge shaft 401 along the hinge axis.

The hinge cam 402 includes a convex portion 402*a* and a concave portion 402*b*. A protrusion 402*c* is formed on the outer circumference of the hinge cam 402, thereby moving the hinge cam 402 forward and backward within the hinge receptor. The hinge cam 402 is slid by the hinge shaft 401, thereby moving forward and backward along the length direction of the hinge receptor 405. A through hole 402*d* is formed in the hinge cam 402 along the hinge axis.

The conductive member 404 includes a contact portion 404*a* disposed between one end 403*b* of the helical hinge spring 403 and a separation wall of the hinge receptor 405 and being in contact with the end 403*b* of the helical hinge spring 403, and a center portion 404*b* disposed within the helical hinge spring 403 and inserted into the through hole 402*d* of the hinge cam 402 and the through hole 401*c* of the hinge shaft 401. A terminal 404*c* of the center portion 404*b* of the conductive terminal 404 has a designated length so as to protrude from the surface of the hinge shaft 401. The diameter of the center portion 404*b* of the conductive member 404 is smaller than that of the through holes 401*c* and 402*d*. Therefore, the conductive member 404 is not influenced by the straight-line motion of the hinge shaft 401 and the hinge cam 402.

The helical hinge spring 403 is disposed between the hinge shaft 401 and the conductive member 404. One end 403*b* of the helical hinge spring 403 is always in contact with the contact portion 404*a* of the conductive member 404, thereby functioning to closely adhere the hinge shaft 401 to the hinge cam 402.

A plate spring 42 is made of a conductive material. The plate spring 42 includes two free terminals, i.e., a first free terminal 421 and a second free terminal 422. The first free terminal 421 of the plate spring 42 is bent to be connected to the terminal 404*c* of the center portion 404*b* of the conductive member 404, and the second free terminal 422 of the plate spring 42 is connected to the power-feeding portion (not shown). Herein, the first free terminal 421 of the plate spring 42 is closely adhered to the terminal 404*c* of the conductive member 404 by an elastic force of the plate spring 42.

When the sub housing is opened and closed from and into the main housing, the hinge shaft 401 is bound by one of the side hinge arms 110, and the hinge cam 402 moves forward and backward over the convex portion 401*b* of the hinge shaft 401. Then, the helical hinge spring 403 is compressed and expanded. Further, the hinge spring 403 is maintained to be in close adherence with the contact portion 404*a* of the conductive member 404. Therefore, the helical hinge spring 403 is always electrically connected to the plate spring 42 by the conductive member 404, and is electrically connected to the power-feeding portion via the plate spring 42.

Hereinafter, with reference to FIGS. 8*a* to 11*b*, the antenna characteristics of the antenna unit using the helical hinge spring in accordance with the first embodiment of the present invention is described in comparison with the conventional antenna unit.

Figure 8A:
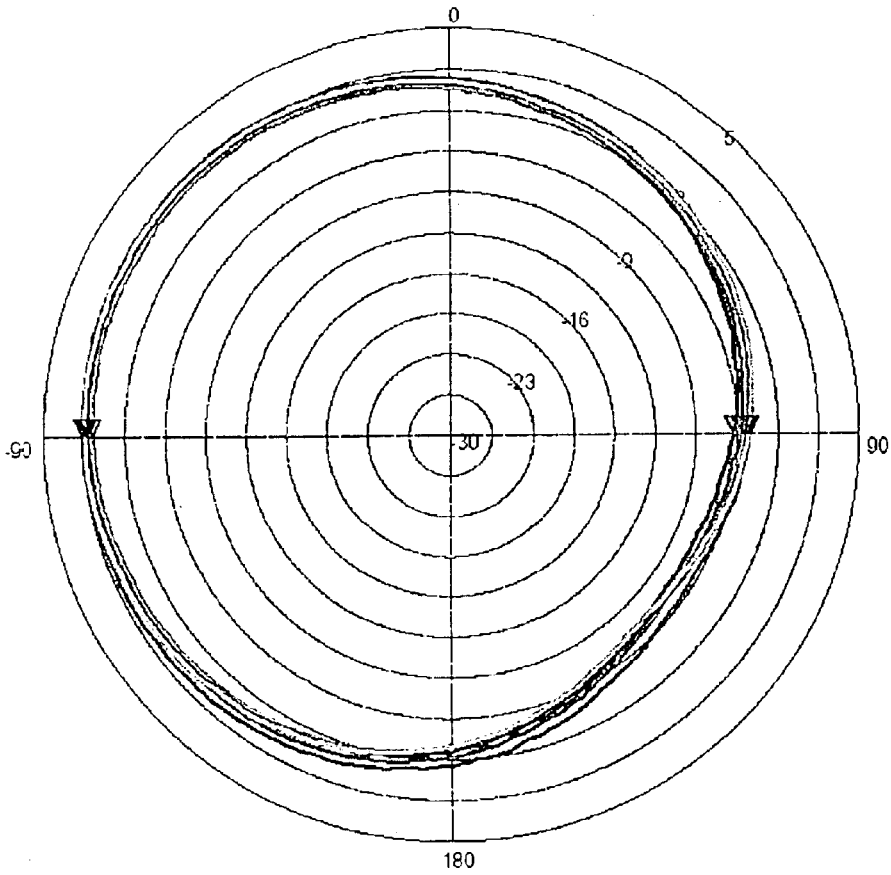
FIG. 8*a* is a graph showing a radiation pattern illustrating the antenna characteristics of a conventional antenna unit using a helical antenna at Korean PCS band (1,750~1,870 MHz) in an open status of a sub housing.
Figure 8B:
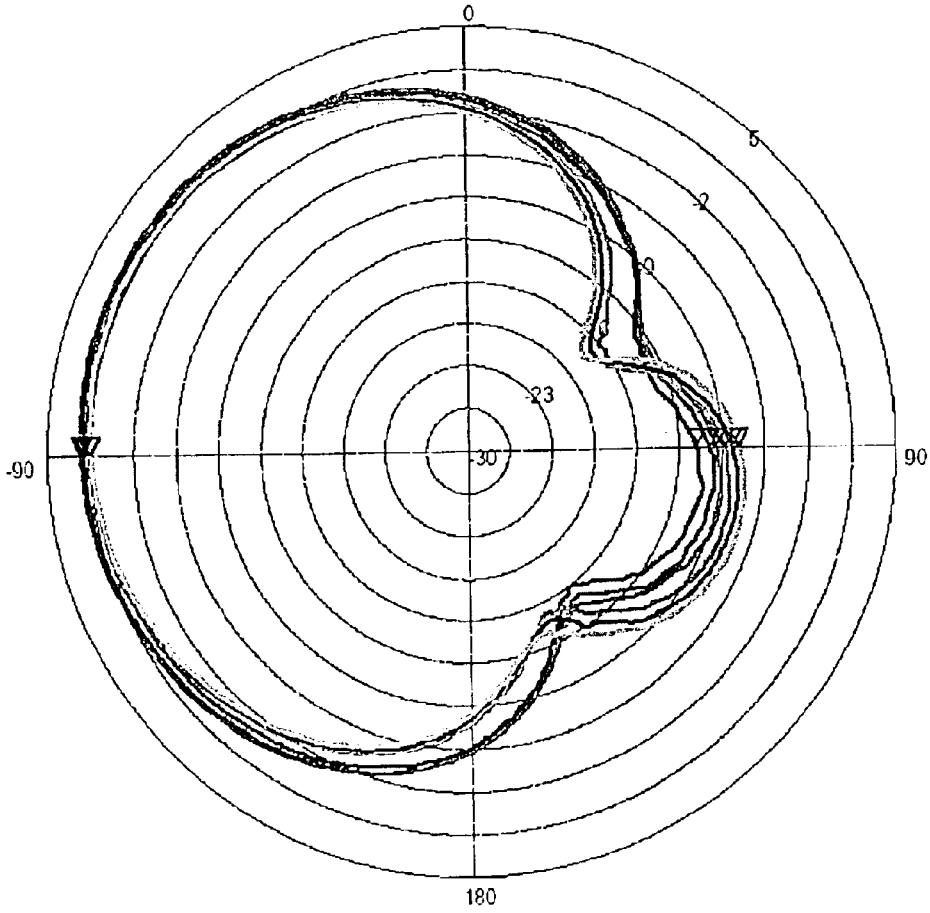
FIG. 8*b* is a graph showing a radiation pattern illustrating the antenna characteristics of the conventional antenna unit using the helical antenna at Korean PCS band (1,750~1,870 MHz) in a closed status of the sub housing.

FIG. 8*a* is a graph showing a radiation pattern illustrating the antenna characteristics of a conventional antenna unit using a helical antenna at Korean PCS band (1,750~1,870 MHz) in an open status of a sub housing, and FIG. 8*b* is a graph showing a radiation pattern illustrating the antenna characteristics of the conventional antenna unit using the helical antenna at Korean PCS band (1,750~1,870 MHz) in a closed status of the sub housing.

Figure 9A:
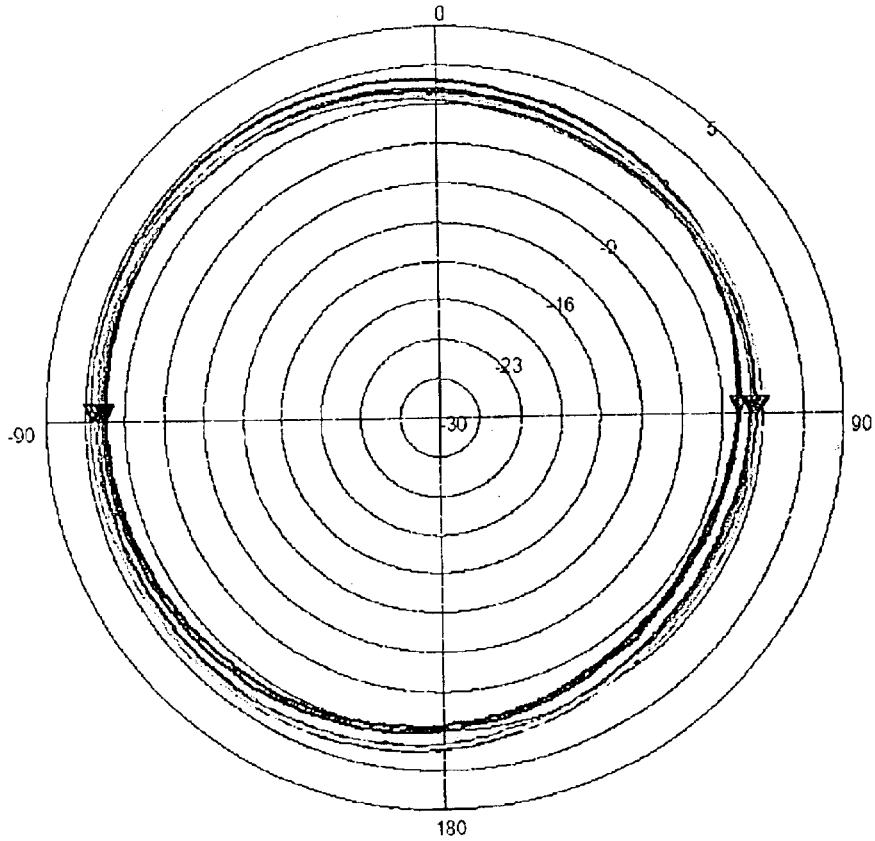
FIG. 9*a* is a graph showing a radiation pattern illustrating the antenna characteristics of the antenna unit using the helical hinge spring at Korean PCS band (1,750~1,870 MHz) in an open status of a sub housing in accordance with the first embodiment of the present invention.
Figure 9B:
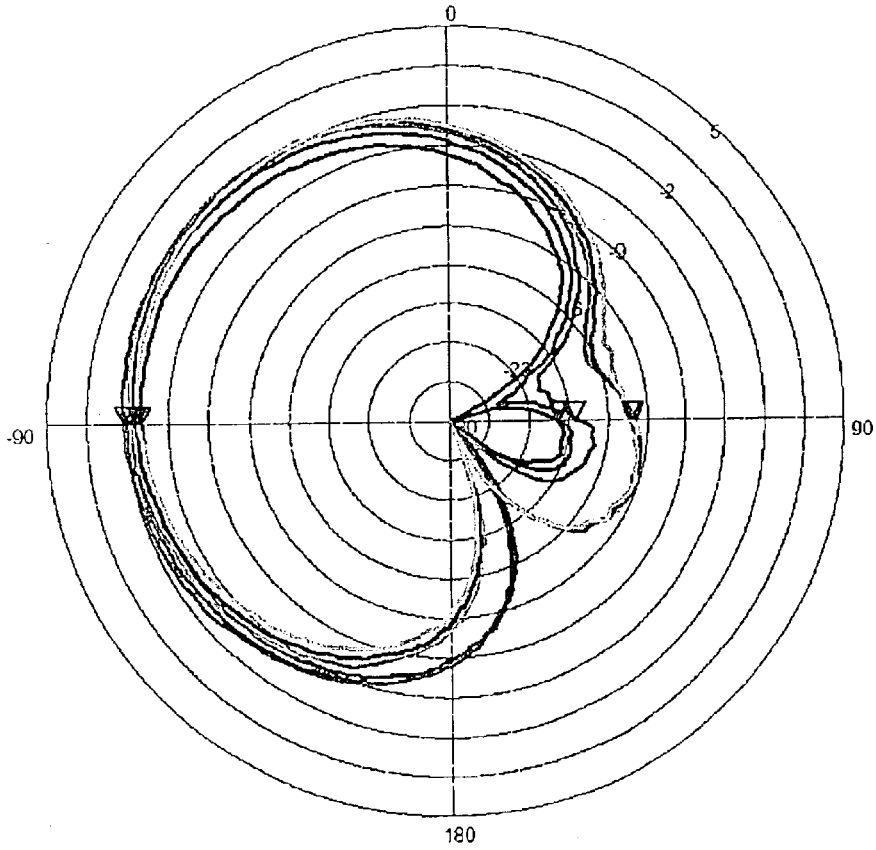
FIG. 9*b* is a graph showing a radiation pattern illustrating the antenna characteristics of the antenna unit using the helical hinge spring at Korean PCS band (1,750~1,870 MHz) in a closed status of the sub housing in accordance with the first embodiment of the present invention.

FIG. 9*a* is a graph showing a radiation pattern illustrating the antenna characteristics of the antenna unit using the helical hinge spring at Korean PCS band (1,750~1,870 MHz) in an open status of a sub housing in accordance with the first embodiment of the present invention, and FIG. 9*b* is a graph showing a radiation pattern illustrating the antenna characteristics of the antenna unit using the helical hinge spring at Korean PCS band (1,750~1,870 MHz) in a closed status of the sub housing in accordance with the first embodiment of the present invention.

As shown in FIGS. 8*a* to 9*b*, a peak gain and a gain of a +90 direction of the antenna unit using the helical hinge spring of the first embodiment of the present invention in the closed status of the sub housing are a little lower than those of the conventional antenna unit. However, those gains of the antenna unit using the helical hinge spring of the first embodiment of the present invention in the open status of the sub housing are higher than those of the conventional antenna unit.

Figure 10A:
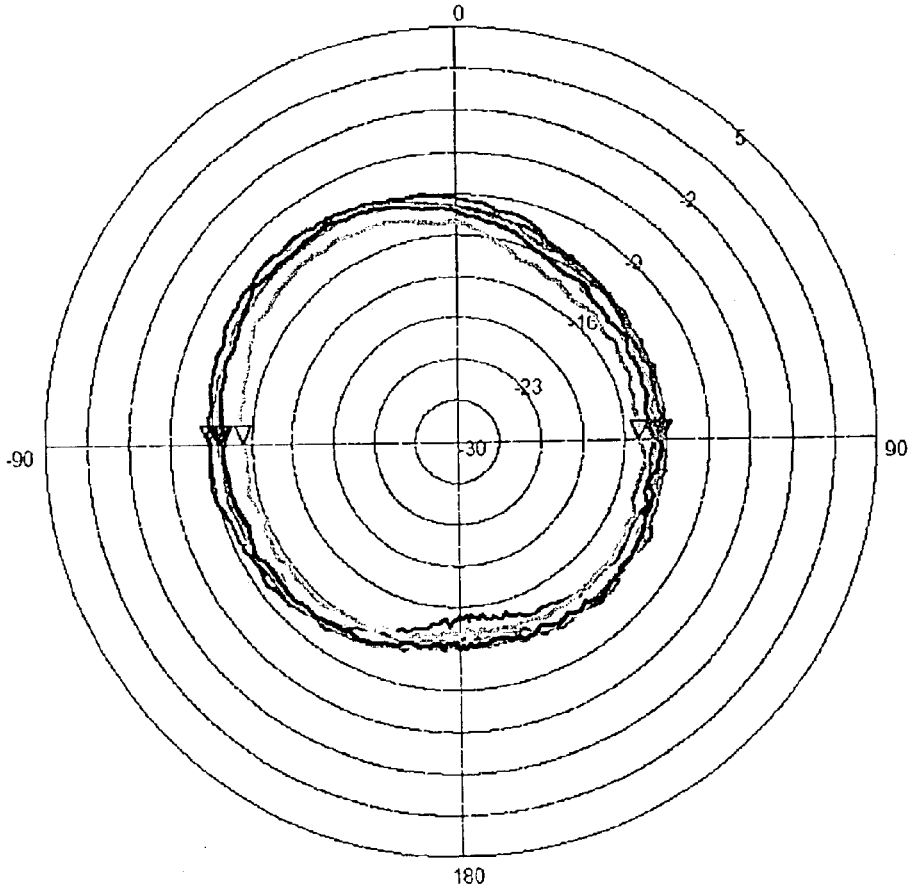
FIG. 10*a* is a graph showing a radiation pattern illustrating the antenna characteristics of a conventional chip type antenna at BT (Blue Tooth) band (2,400~2,483 MHz) in an open status of a sub housing.
Figure 10B:
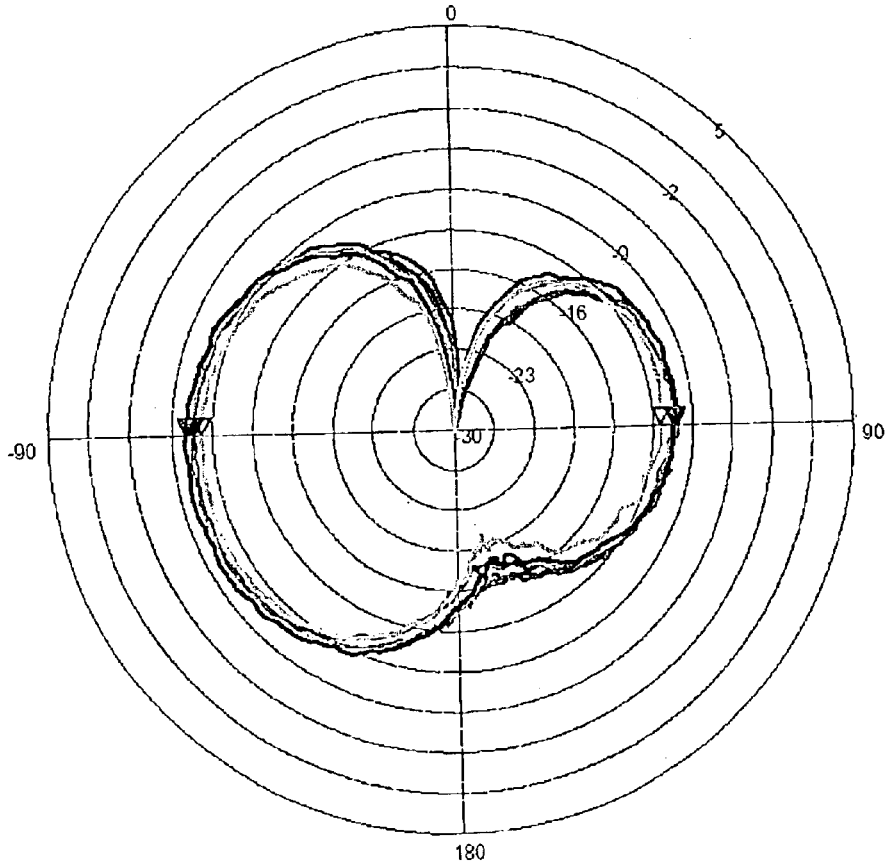
FIG. 10*b* is a graph showing a radiation pattern illustrating the antenna characteristics of the conventional chip type antenna at BT (Blue Tooth) band (2,400~2,483 MHz) in a closed status of the sub housing.

FIG. 10*a* is a graph showing a radiation pattern illustrating the antenna characteristics of the conventional chip type antenna at BT (Blue Tooth) band (2,400~2,483 MHz) in an open status of a sub housing, and FIG. 10*b* is a graph showing a radiation pattern illustrating the antenna characteristics of the conventional chip type antenna at BT (Blue Tooth) band (2,400~2,483 MHz) in a closed status of the sub housing.

Figure 11A:
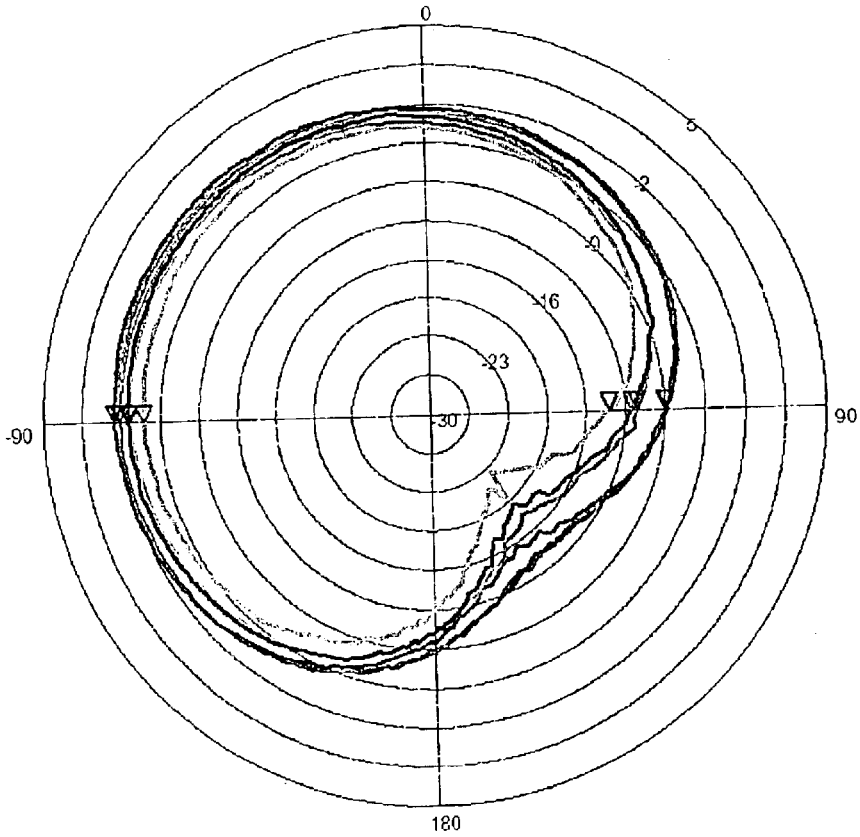
FIG. 11*a* is a graph showing a radiation pattern illustrating the antenna characteristics of the antenna unit using the helical hinge spring at BT (Blue Tooth) band (2,400~2,483 MHz) in an open status of a sub housing in accordance with the first embodiment of the present invention.
Figure 11B:
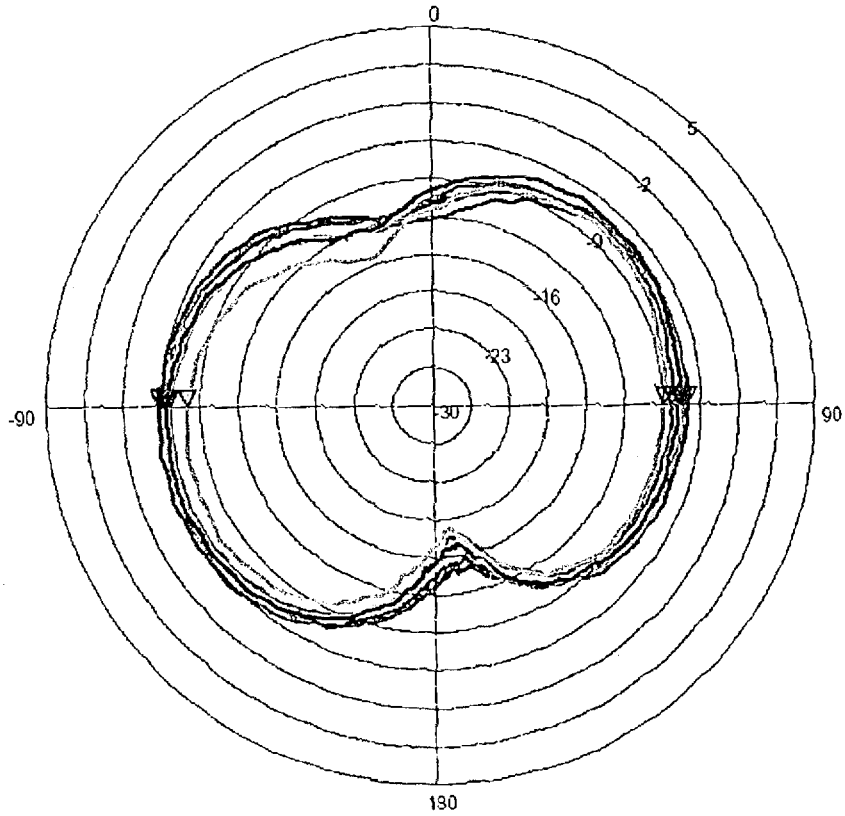
FIG. 11*b* is a graph showing a radiation pattern illustrating the antenna characteristics of the antenna unit using the helical hinge spring at BT (Blue Tooth) band (2,400~2,483 MHz) in a closed status of the sub housing in accordance with the first embodiment of the present invention.

FIG. 11*a* is a graph showing a radiation pattern illustrating the antenna characteristics of the antenna unit using the helical hinge spring at BT (Blue Tooth) band (2,400~2,483 MHz) in an open status of a sub housing in accordance with the first embodiment of the present invention, and FIG. 11*b* is a graph showing a radiation pattern illustrating the antenna characteristics of the antenna unit using the helical hinge spring at BT (Blue Tooth) band (2,400~2,483 MHz) in a closed status of the sub housing in accordance with the first embodiment of the present invention.

As shown in FIGS. 10*a* to 11*b*, the peak gain and an average gain of the antenna unit using the helical hinge spring of the first embodiment of the present invention in the open and closed status of the sub housing are higher than those of the conventional antenna unit. The helical hinge spring of the present invention has a diameter of approximately 4.3 mm and a length of approximately 9.5 mm. Therefore, if the helical hinge spring has a greater diameter and length using a bigger hinge module, an antenna unit with further improved antenna characteristics can be obtained.

Additionally, the helical hinge spring of the present invention is designed to satisfy the antenna characteristics by adjusting the diameter and the length of the helical hinge spring, thereby being used as various kinds of antennas.

Consequently, the antenna unit using helical hinge spring of the present invention can be substituted for the conventional antenna at Korean PCS band or BT (Blue Tooth) band. Therefore, the antenna unit of the present invention satisfies the miniaturization of the main body of the portable terminal, improves a portable function of the portable terminal, and allows more flexible designing of an external appearance of the portable terminal.

For example, as the hinge module is enlarged by the increase of the size of the main body of the terminal, the length and/or diameter of the helical hinge spring may also be increased, thereby improving the antenna gain by the helical hinge spring.

As apparent from the above description, according to the present invention, the antenna unit is obtained using a hinge module, thereby allowing more flexible designing of an external appearance of the portable terminal using the antenna and reducing the production cost of the antenna. Further, the present invention does not require an internal space for accommodating an additional antenna, thereby maximizing space utilization and satisfying a lightweight trend. Moreover, the antenna unit of the present invention can be used as a supplementary antenna of a dual band terminal operated at a combined band of PCS, CDMA, AMPS, GSM, GPS, BT (blue tooth), and so on, and as a diversity antenna for increasing the data speed of a terminal requiring a super high-speed data communication such as a HDR.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An antenna unit using a helical hinge spring which is used in a portable terminal including (A) a main housing, (B) a sub housing, and (C) a hinge module rotatably opening and closing the sub housing from and into the main housing and including a hinge shaft having one end fixedly attached to the main housing and the other end positioned within the sub housing and serving to interconnect the main housing and the sub housing, a hinge cam being slid by the hinge shaft and moving forward and backward, the helical hinge spring providing a force for closely adhering the hinge shaft to the hinge cam, and a hinge housing for accommodating the hinge shaft, the hinge cam, and the helical hinge spring, said antenna unit comprising:

(a) the helical hinge spring disposed in a direction of a hinge axis and serving as a helical antenna; and (b) a conductive member including a contact portion disposed between the helical hinge spring and the hinge cam and closely adhered to the helical hinge spring, and a center portion extending from a center of the contact portion in the direction of the hinge axis and passing through the hinge cam and the hinge shaft.

2. The antenna unit of claim 1, further comprising a connecting member closely adhered to the conductive member.

3. The antenna unit of claim 2, wherein the first free terminal of the connecting member is closely adhered to a terminal of the center portion of the conductive member by an elastic force of the connecting member.

4. The antenna unit of claim 3, wherein the connecting member includes a plate spring having a first free terminal closely adhered to the conductive member and a second free terminal connected to a power-feeding portion.

5. The antenna unit of claim 4, further comprising a connecting member closely adhered to the conductive member.

6. The antenna unit of claim 5, wherein the first free terminal of the connecting member is closely adhered to a terminal of the center portion of the conductive member by an elastic force of the connecting member.

7. The antenna unit of claim 5, wherein the connecting member includes a plate spring having a first free terminal closely adhered to the conductive member and a second free terminal connected to a power-feeding portion.

8. The antenna unit of claim 1, wherein the hinge shaft comprises a first through hole along the hinge axis and the hinge cam comprises a second through hole along the hinge axis so that the center portion of the conductive member passes through the first and second through holes.

9. The antenna unit of claim 8, wherein the diameter of the first and second through holes is greater than that of the center portion of the conductive member.

10. The antenna unit of claim 1, wherein a terminal of the center portion of the conductive member protrudes from the hinge shaft.

11. An antenna unit using a helical hinge spring which is used in a portable terminal including (A) a main housing, (B) a sub housing, and (C) a hinge receptor rotatably opening and closing the sub housing from and into the main housing and including a hinge shaft having one end fixedly attached to the main housing and the other end positioned within the sub housing and serving to interconnect the main housing and the sub housing, a hinge cam being slid by the hinge shall and moving forward and backward, and the helical hinge spring providing a force for closely adhering the hinge shaft to the hinge cam, said antenna unit comprising:

(a) the helical hinge spring disposed in a direction of a hinge axis and serving as a helical antenna; and (b) a conductive member including a contact portion closely adhered to the helical hinge spring, and a center portion extending from a center of the contact portion in the direction of the hinge axis and passing through the helical hinge spring, the hinge cam and the hinge shaft.

12. The antenna unit of claim 11, wherein the hinge shaft comprises a first through hole along the hinge axis and the hinge cam comprises a second through hole along the hinge axis so that the center portion of the conductive member passes through the first and second through holes.

13. The antenna unit of claim 12, wherein the diameter of the first and second through holes is greater than that of the center portion of the conductive member.

14. The antenna unit of claim 11, wherein a terminal of the center portion of the conductive member protrudes from the hinge shaft.

15. A hinge apparatus of a portable terminal comprising:

a hinge housing;

a hinge shaft disposed within the hinge housing;

a hinge cam disposed within the hinge housing and being slid by the hinge shaft;

a helical hinge spring disposed in a direction of the hinge housing, serving to closely adhere the hinge shaft to the hinge cam, and simultaneously serving as a helical antenna; and a conductive member including a contact portion disposed between the helical hinge spring and the hinge cam and closely adhered to the helical hinge spring, and a center portion extending from a center of the contact portion in the direction of the hinge axis and passing through the hinge cam and the hinge shaft.

16. The antenna unit of claim 15, further comprising a connecting member closely adhered to the conductive member.

17. The antenna unit of claim 16, wherein the first free terminal of the connecting member is closely adhered to a terminal of the center portion of the conductive member by an elastic force of the connecting member.

18. The antenna unit of claim 16, wherein the connecting member includes a plate spring having a first free terminal closely adhered to the conductive member and a second free terminal connected to a power-feeding portion.

* * * * *